US012599244B2

(12) United States Patent
Janssens

(10) Patent No.: US 12,599,244 B2
(45) Date of Patent: Apr. 14, 2026

(54) ADJUSTABLE BED EXTENSION

(71) Applicant: Erin Janssens, Corbett, OR (US)

(72) Inventor: Erin Janssens, Corbett, OR (US)

( * ) Notice: Subject to any disclaimer, the term of this patent is extended or adjusted under 35 U.S.C. 154(b) by 0 days.

(21) Appl. No.: 18/763,877

(22) Filed: Jul. 3, 2024

(65) Prior Publication Data

US 2026/0007243 A1 Jan. 8, 2026

(51) Int. Cl.
*A47C 19/04* (2006.01)
*A47C 19/02* (2006.01)

(52) U.S. Cl.
CPC ..... *A47C 19/04* (2013.01); *A47C 19/021* (2013.01)

(58) Field of Classification Search
CPC ..... A47C 19/04; A47C 19/021; A47C 19/005; A47C 19/22; A47C 19/124; A47C 19/045; A47C 19/025; A47C 19/022; A47C 23/005
USPC ..... 5/181, 201, 285, 661, 184
See application file for complete search history.

(56) References Cited

U.S. PATENT DOCUMENTS 2,607,932 A * 8/1952 Doyle ..... A47C 19/04 5/184
3,688,321 A * 9/1972 Moss ..... A47C 19/04 5/661
4,271,547 A * 6/1981 Grossutti ..... A47C 23/005 5/661
4,376,316 A 3/1983 Mecier et al.
4,937,905 A * 7/1990 Thaxton, Jr. ..... A47C 19/04 5/285
6,047,422 A * 4/2000 Yousif ..... A47C 19/04 5/507.1
6,151,738 A * 11/2000 Arr ..... A47C 19/04 5/2.1
7,690,058 B1 4/2010 Dwyer et al.

FOREIGN PATENT DOCUMENTS

CN 217309651 U 8/2022

OTHER PUBLICATIONS

International Search Report and Written Opinion for PCT Application No. PCT/US2025/036503, dated Oct. 15, 2025, pp. 1-18.

* cited by examiner

*Primary Examiner* — Madison Matthews
(74) *Attorney, Agent, or Firm* — Chernoff, Vilhauer LLP

(57) ABSTRACT

Adjustable bed extension systems are disclosed. Various embodiments of the present invention address the limitations of traditional bed designs by providing additional length to existing beds and include bedframe extensions, boxspring/platform extensions, backer board, and mattress extensions, offering customizable solutions for individuals seeking enhanced comfort and space optimization, catering to various bed sizes and configurations.

19 Claims, 10 Drawing Sheets

ADJUSTABLE BED EXTENSION

CROSS REFERENCE TO RELATED APPLICATIONS

None

FIELD OF THE INVENTION

The present invention relates to an adjustable bed extension that enhances the length of standard beds without requiring custom bedframes, mattresses, or bedding. Tailored to accommodate individuals seeking increased space and comfort, this invention addresses the need for extended sleeping surfaces for taller individuals or those desiring additional room. By introducing a novel framework extension, adjustable platform, and foam components, the adjustable bed extension provides a solution for extending the usable length of existing beds while maintaining stability, adjustability, and the ability to use standard bedding.

BACKGROUND

The typical dimensions of standard beds often fail to accommodate the needs of taller individuals, particularly in terms of length. A portion of the bed's overall length is consumed by pillows, leaving limited space for individuals to comfortably stretch. For instance, in an 80-inch king-sized bed, approximately 20 inches are lost to a single pillow, with the head area utilizing roughly 12 inches of the pillows, leaving only 72 inches for sleeping. This leaves taller individuals, especially those over 6 feet tall, with inadequate space to fully extend their legs, or without experiencing undue pressure and tightness at their feet. Consequently, many taller individuals find themselves sleeping curled on their sides or diagonally to mitigate discomfort, rather than being able to sleep on their backs, stomachs, or fully stretched out.

Common bed sizes exacerbate this issue, with standard sizes such as twin, full, queen, king, and California king often failing to provide adequate length for taller individuals. For instance, a standard twin bed typically measures 39 inches by 75 inches, a full bed measures 54 inches by 75 inches, a queen bed measures 60 inches by 80 inches, a king bed measures 76 inches by 80 inches, and a California king bed measures 72 inches by 84 inches. These dimensions may suffice for individuals of average height or below, but they fall short for taller individuals who require additional length for comfortable rest and sleep.

In addition to bed dimensions, pillow sizes also play a significant role in reducing available sleeping space. Standard pillows, queen pillows, king pillows, and Euro pillows, or a combination thereof, are commonly used, reducing the usable length of the bed.

Statistics on global and United States population heights underscore the need for solutions tailored to taller individuals. In the United States, approximately 1% of women and 14.5% of men are 6 feet or taller. This trend is mirrored in many other countries such as the Netherlands, Denmark, and Germany, where a significant portion of the population is taller than average height globally.

Given these challenges, what is needed, therefore, is an adjustable bed and mattress extension that can effectively extend existing bedframes and mattresses without requiring custom-made beds, mattresses, and bedding. Such a solution would provide additional space for taller individuals to sleep comfortably in their preferred position, whether it be on their back, stomach, side, or diagonally, thereby enhancing overall comfort and sleep quality.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
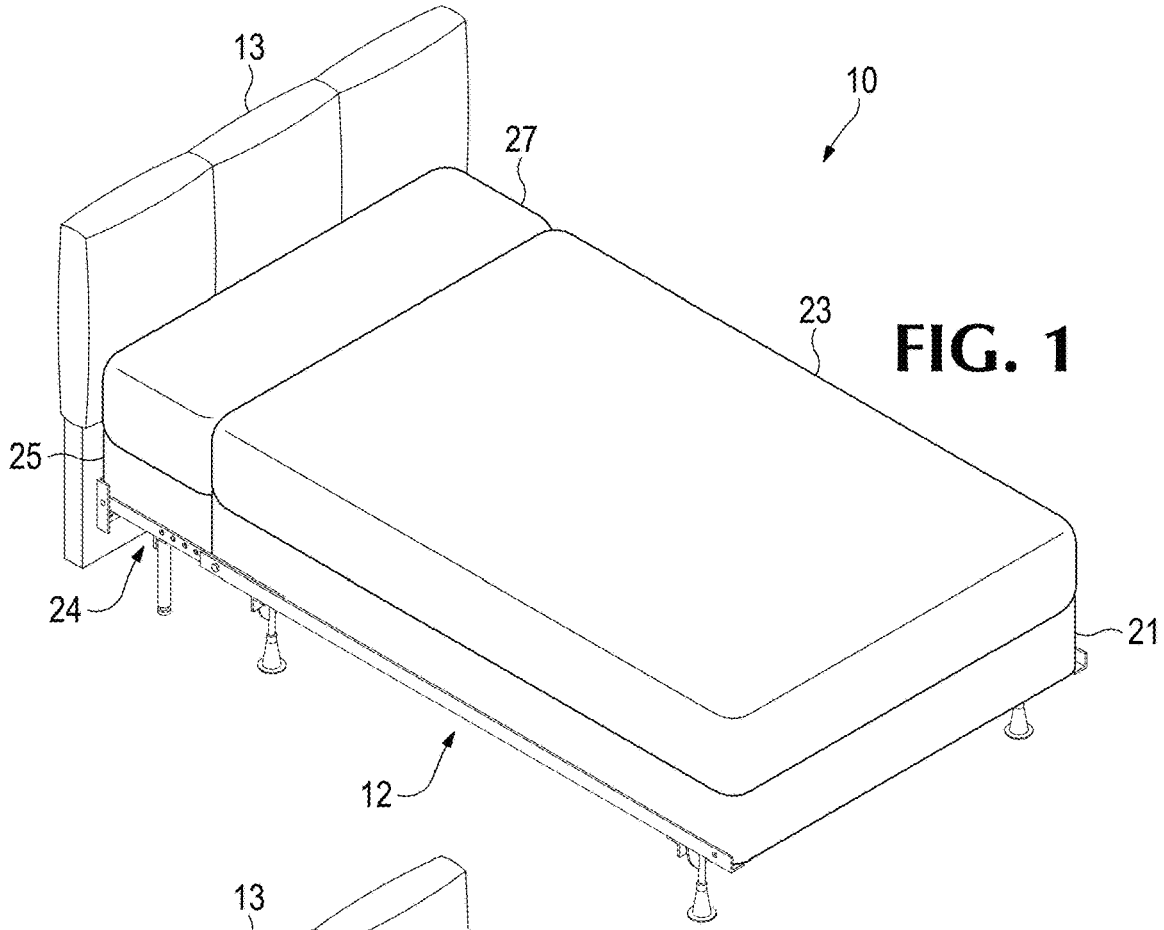
FIG. 1 is a perspective view of an embodiment of a bedframe, boxspring/platform, and mattress extensions at the head end of a bed.

Sleep is becoming increasingly recognized scientifically as critically important to both our overall physical and mental health. The evolution of sleep systems has long been driven by the pursuit of enhanced comfort, adaptability, and space optimization. Traditional bed designs face challenges in accommodating individuals with specific needs, such as taller individuals, or anyone who requires more sleeping space, particularly length. For example, firefighters, professional athletes, and military personnel would benefit from the present invention, as they often need additional space and require optimal rest and recovery after strenuous activities. The invention presented herein introduces an adjustable bed extension system, addressing these challenges by providing a versatile solution that extends existing bedframes, boxsprings/platforms, and mattresses without the need for custom-made, often costly, alternatives.

Conventional bed sizes, including twin, full, queen, king, and California king, are limited in their ability to accommodate taller individuals due to their overall length as well as space occupied by pillows. As previously discussed, an 80-inch king-sized bed typically loses approximately 20 inches to pillows, allowing for roughly 12 inches of headrest on the pillows, leaving only approximately 72 inches for sleeping. This limitation can result in discomfort and restricted movement, particularly for individuals over 6 feet tall.

To overcome these limitations, the adjustable bed extension system provides additional length to existing beds, allowing individuals to sleep more comfortably. The adjustable bed extension system, in a first embodiment, incorporates a bedframe extension and/or a boxspring/platform extension, and a mattress extension. These extensions work in tandem to extend a standard bed, and they are referred to collectively as an adjustable bed extension system.

Furthermore, the present invention allows for the continued use of standard available sheets and bedding, ensuring seamless integration with existing bedding accessories enhancing both user convenience and aesthetics. Users can easily utilize their preferred sheets and bedding without the need for specialized or custom-sized linens, thereby simplifying the transition to the extended bed length provided by the adjustable bed extension system. Users may also use custom-fitted bottom sheets and full-length mattress pads to further enhance the functionality and comfort of the system.

Beginning with the bedframe extension, it includes two adjustable support beams opposite one another, one or more crossbars connecting the support beams, one or more adjustable legs to support the one or more crossbars and/or support beams. Each support beam is adjustably connected to one end of an existing support beam of standard bedframes, e.g., straight rail or Hollywood bedframe. The support beam length is adjustable such that the length of the extension system is set to a desired length, and may be made a variety of sizes and/or be adjustable, to accommodate the desired width and length, or height of the extension system. This can be accomplished using, for example, a telescoping design where one section of the support beam slides into another, allowing for adjustable length. An alternative is using adjustable screws or bolts with pre-drilled holes at different positions along the support beam to allow for manual adjustment. Sliding channels within the support beam structure can be used to accommodate a locking pin, bolts with nuts, or other mechanism to adjust the length. In preferred embodiments, each supporting beam incorporates a cutout of a size large enough, not only to fit around existing bolts in the existing bedframe, but of size large enough to adjust the length of extension by several inches. For example, the cutout may be 6 inches long, 8, inches long, 10 inches long, thereabouts, and so on. Other alternatives may be used as discussed in further detail below. In some embodiments, the support beams may be extendable from 3 inches to 24 inches.

The support beams are designed to be extendable, as described above, and are further configured to receive one or more crossbars at various locations along their length, using for example pre-drilled holes. The crossbars may be positioned and secured within the support beams to provide additional support for the boxspring/platform and/or the mattress, distributing weight evenly. This configuration allows for flexibility in adjusting the support structure of the bedframe to accommodate different mattress sizes and user preferences.

Each crossbar is designed to be adjustably connected to the support beams, allowing for flexibility in accommodating different bed lengths and sizes, including standard, platform, and adjustable style bedframes. The length of the crossbars can be adjusted to match the width of the existing bedframe, ensuring proper stability, support for the mattress, and aesthetics. This adjustability can be achieved using various mechanisms, such as telescoping designs, adjustable screws and bolts with pre-drilled holes at different positions along the crossbars, or sliding channels within the crossbar structure to accommodate locking pins or mechanisms. Other alternatives for adjusting the length of the crossbars may also be utilized.

Regarding the legs of the bedframe extension, they are designed to be adjustable in height to match the height of the existing bedframe or both the existing bedframe and existing boxspring. This ensures proper alignment and support when the extension is attached. The legs can be adjusted using various mechanisms to accommodate different heights and configurations. For example, telescoping legs with inner and outer sections can be extended or retracted to achieve the desired height. Another option is the use of adjustable screw-in legs, where the length can be adjusted by turning a screw mechanism at the base of the leg. Additionally, spring-loaded legs with adjustable pins or buttons may be employed, allowing for quick and easy height adjustments. These adjustable legs can be attached to either the crossbars, the support beams, or both, providing versatility in installation. Attachment to the crossbars or support beams can be achieved through various means, such as screw-in connections, brackets, clamps, or screwing into pre-drilled holes in the crossbars and support beams. This allows for secure and stable positioning of the legs, ensuring the stability and functionality of the extended bedframe. Although attachment mechanisms are discussed with respect to connecting specific components to one another, many of the attachment mechanisms described herein may be interchangeable.

To complete the bedframe extension portion of the system, a versatile bracket having several horizontal pre-drilled cutouts, several vertical pre-drilled cutouts, or a combination of the horizontal and vertical cutouts is utilized. The bracket is used at either one end of each support beam if the existing bedframe does not have a corner bracket, or at both ends of the support beams if the existing bedframe already has a corner bracket. This bracket is designed to accommodate various attachment scenarios and ensures proper alignment and support of the bedframe extension. The bracket is preferably adjustable in height to raise and lower the extension as needed, using for example several cutouts in the bracket, to match the existing bedframe, and/or with a headboard, footboard, or backer board. In an embodiment, the bracket comprises a sliding mechanism that allows it to move up and down relative to the support beam, providing flexibility in aligning the extension with the existing bedframe. This sliding mechanism may include channels or tracks integrated into the support beam, along which the bracket can slide freely. Additionally, the bracket may feature locking mechanisms or adjustable screws and/or bolts to secure it in place once the desired height is achieved. This ensures stability and prevents unwanted movement of the extension. Furthermore, the bracket may have multiple attachment points or holes to accommodate different bedframe configurations and ensure a secure fit.

The boxspring/platform extension, which may not be required in some embodiments, is designed to match the size of the bedframe extension and provide additional, adjustable support for the mattress extension. As such, it may be made of a variety of sizes and/or be adjustable, to accommodate the desired width, length, or height of the extension system. It can also be made of any suitable material, such as wood, metal, or a combination thereof, depending on the desired strength, durability, and weight requirements. The boxspring/platform can be made in a variety of lengths through adjustment of the crossbar, thereby extending the width and size of the boxspring and/or platform. The crossbar may be extendable via telescoping sections, locking mechanisms, or other adjustable means. In some embodiments, the crossbar may extend from 38 inches to 76 inches.

One option for the boxspring/platform extension is a design that matches the size of the bedframe extension and the existing boxspring height precisely. This can be achieved by constructing a sturdy frame using materials like steel or hardwood, with dimensions that align with those of the bedframe extension. The frame can be covered with a fabric, mesh, wood, or other material to provide support for the mattress while allowing for adequate ventilation.

Another option is an adjustable boxspring/platform extension, which can accommodate different existing boxspring heights and dimensions. This can be achieved using a telescoping or folding mechanism, allowing the boxspring/platform extension to expand or contract as needed to match the size of the existing boxspring. For example, the boxspring/platform extension may feature sections that slide or fold out to adjust its height, ensuring an even surface with the existing boxspring, if any. Alternatively, a crank or ratchet mechanism can be utilized, which cranks two separate solid sheets of materials, thereby increasing or decreasing the height of the boxspring/platform.

Additionally, a boxspring/platform extension can be constructed using 2×4 or other dimensional lumber. This involves building a frame using dimensional wood as the main structural elements, with slats or plywood panels laid across the top to support the mattress. The size of the boxspring/platform extension can be customized by adjusting the dimensions of the lumber used and the spacing between the slats or plywood panels. In embodiments, in the absence of an existing headboard providing backing to any boxspring/platform and mattress extension, a backer board may be recommended. Regardless of the design, the boxspring/platform extension is designed to be sturdy and stable to provide proper support for the mattress and ensure a secure, adjustable surface to place the mattress extension.

While the backer board is referred to herein as a "board," it is to be understood that it can be made of various materials such as wood, stiff plastic, wire/rod, steel, or other frameworks to contain and secure the mattress extension. Other options include Velcro-like attachments or securing with a band/lash type system.

To complete the first embodiment, the mattress extension is designed to match the size of the bedframe extension, providing a seamless sleeping surface, and ensuring comfort and support for the user. The mattress extension may be constructed of various materials, such as foam, springs, a combination thereof, or any other suitable materials to achieve the desired level of comfort and support. It can also be made of a variety of sizes and/or be adjustable, to accommodate the desired width, length, or height of the bed extension system. The position of the mattress extension and existing mattress may be interchangeable. Meaning, the existing mattress may be pushed onto the bedframe extension and/or boxspring/platform, leaving the mattress extension room to fit into the existing bedframe and existing boxspring, or combination thereof.

In embodiments, the mattress extension may feature a curved design on one end where it abuts the existing mattress to blend in and cover any gap between the mattress extension and the existing mattress. This curved design creates a smooth transition between the two sections, eliminating any gaps and providing a more cohesive look to the system. The curve may be gentle, more pronounced, or, in embodiments, absent altogether, depending on the desired aesthetic and functional requirements of the existing mattress.

In further embodiments, the mattress extension may be available in different heights or depths to accommodate varying preferences and bedframe requirements. Specifically, the mattress extensions could be manufactured or sold in standard depths, such as 8 inches, 11 inches, and 14 inches. Additionally, finished pads in varying depths, such as 1 inch, 2 inches, 3 inches, or 4 inches, could be provided. These pads may be attached to the bottom of the mattress extension using Velcro® or a similar fastening method. This allows for easy adjustments to the overall mattress height if the bedframe or box spring/platform is unable to accommodate the initial depth difference. These supplemental pads ensure flexibility and customization for the user without the need for adjustable mechanisms within the mattress itself.

The first embodiment is described with respect to an extension at the head end of an existing bed utilizing the bracket. The bracket may be used to secure the bedframe extension into an existing headboard, a backer board, or a wall as needed. The same design may also be utilized at the foot end of the existing bed. The bracket for the foot end bedframe extension may be used to secure the extension to a footboard or a backer board. The bracket may alternately be done away with in favor of a corner crossbar connecting the support beams where the brackets would have been. This serves to secure the extension mattress or the existing mattress, and provides for a more finished, cohesive look. A finishing frame may be wrapped around the foot end bedframe extension by attaching it to the corner crossbar providing further stability in securing the boxspring/platform extension and the mattress extension, or portions thereof.

In a second embodiment of the present invention, the system comprises an adjustable platform, an optional boxspring/platform extension, and a mattress extension, offering a comprehensive solution for extending the usable length of beds. The optional boxspring/platform and mattress extensions are similar to those described with respect to the first embodiment. Put differently, the system may include an adjustable platform that also serves as the boxspring/platform extension, supporting the mattress extension, offering a comprehensive solution for extending the usable length of beds. The adjustable boxspring/platform and mattress extensions are similar to those described with respect to the first embodiment.

The adjustable platform of the second embodiment provides a versatile and adaptable solution for extending the length of beds. It includes four height-adjustable legs, however, certain embodiment may require fewer or additional legs (e.g., additional leg in the middle), each capable of adjusting up to approximately 10 inches to accommodate various bed heights and preferences. The legs feature several cutouts that run through the entirety of the leg, allowing them to attach securely to existing brackets in the bedframe, or in the absence of existing brackets, brackets or similar attachment mechanisms are provided.

The height adjustability of the legs enables seamless integration with different bedframes, ensuring proper alignment and stability. The legs can be adjusted using various mechanisms, such as telescoping designs or adjustable screw-in mechanisms. For example, the telescoping legs may feature inner and outer sections that slide within each other, allowing for easy adjustment of the leg height. Alternatively, adjustable screw-in mechanisms at the base of the legs can be turned to extend or retract the legs as needed. In some embodiments, a combination of the two mechanisms, or other means of adjustability is utilized.

Two of the legs are designed to connect to a headboard, footboard, backer board, or remain unsecured. The remaining legs directly connect to the existing bedframe, providing additional stability and support. These connections can be achieved using brackets, screws, or other suitable fasteners, allowing for secure attachment to the existing bed structure. In embodiments, an additional leg may be added in the center of the platform for added support.

The legs are designed to hold a platform made of sturdy materials such as standard dimensional lumber or metal framing, or a frame of any suitable material, ensuring durability and stability. The platform's surface and dimensions are/can be adjusted to match those of the desired extension, providing a solid base and backing for the mattress extension or existing mattress. The platform provides a solid base and keeps the mattress in place, ensuring even weight distribution for optimal comfort and support. Its height can be adjusted to match the existing boxspring height, eliminating the need for additional boxspring/platform extensions in many cases.

If the top of the platform matches the height of the existing boxspring, and the extension mattress matches the height of the existing mattress, only the solid top surface of the framework and an extension mattress are needed to complete this system. This streamlined design reduces the need for additional components and simplifies installation. However, if the top of the platform does not align with the existing boxspring, an optional boxspring/platform extension or components to extend for additional height may be included. This extension matches the size of the platform and provides additional support for the mattress, ensuring a seamless transition between the existing boxspring and the extension mattress.

The depth of the existing mattress may be measured and compared to determine the ideal height of the top of the boxspring/platform. Due to various thicknesses and styles of mattresses, mattress extensions may be offered in various depths to assist in ensuring the two mattresses are level, as well as a curved or straight/box style fit.

In a third embodiment of the present invention, the adjustable bed extension system retains the fundamental design elements of the first embodiment while introducing two key modifications for enhanced stability and versatility. Similar to the first embodiment, this system comprises a bedframe extension, a boxspring/platform extension, and a mattress extension.

The bedframe extension in the third embodiment features two support beams, each equipped with adjustable support legs and crossbars to provide additional support and stability. Unlike the first embodiment, the support beams in this embodiment do not incorporate a cutout. Instead, they are designed to securely attach to existing bedframes using a bracket as previously described, without the need for modification.

Each support beam in the third embodiment is outfitted with two brackets, one at each end, to facilitate attachment to the existing bedframe, and optionally, a headboard, a footboard, or a backer board. These brackets serve as secure connection points, ensuring proper alignment and stability of the extension bedframe. The brackets are adjustable in height to accommodate different bedframe configurations and can be easily adjusted to match the height of the existing bedframe.

The adjustable support legs of the bedframe extension are designed to accommodate various bed heights, allowing for seamless integration with existing bedframes. These legs may be adjustable up to approximately 10 inches and feature multiple cutouts that allow them to attach to the brackets on the supporting beams. This design provides flexibility in installation and ensures a secure and stable connection between the bedframe extension and the existing bedframe.

The optional boxspring/platform extension in the third embodiment is similar to that of the first embodiment and can be adjusted to match the height and dimensions of the existing boxspring or height necessary to ensure the mattress extension is level with the existing mattress. It may feature telescoping or folding mechanisms to accommodate different boxspring configurations, providing additional support for the mattress extension.

The mattress extension is designed to match the size and dimensions of the extended bedframe, providing a seamless sleeping surface for the user. It may be constructed of various materials, such as foam, springs, a combination thereof, or other material to achieve the desired level of comfort and support. The mattress extension may come in different depths to help either match the existing mattress, or provide additional adjustability of the overall height, ensuring it is at the desired height.

Overall, the third embodiment of the adjustable bed extension system offers an efficient and versatile solution for extending the length of beds without the need for custom-made alternatives. Because of its design, the system as described in third embodiment may be interchangeably used at either the head end or foot end of existing bedframe. By incorporating two brackets on each supporting beam and eliminating the cutout, this embodiment ensures enhanced stability and compatibility with existing bedframes, and a headboard, footboard, or a backer board, making it suitable for a wide range of applications and environments.

The first embodiment of the present invention, as shown in FIGS. 1, 3, 4, 5, and 7, introduces a versatile bed extension system 10 designed to address the limitations of traditional bed designs by providing additional length to existing beds.

Figure 4:
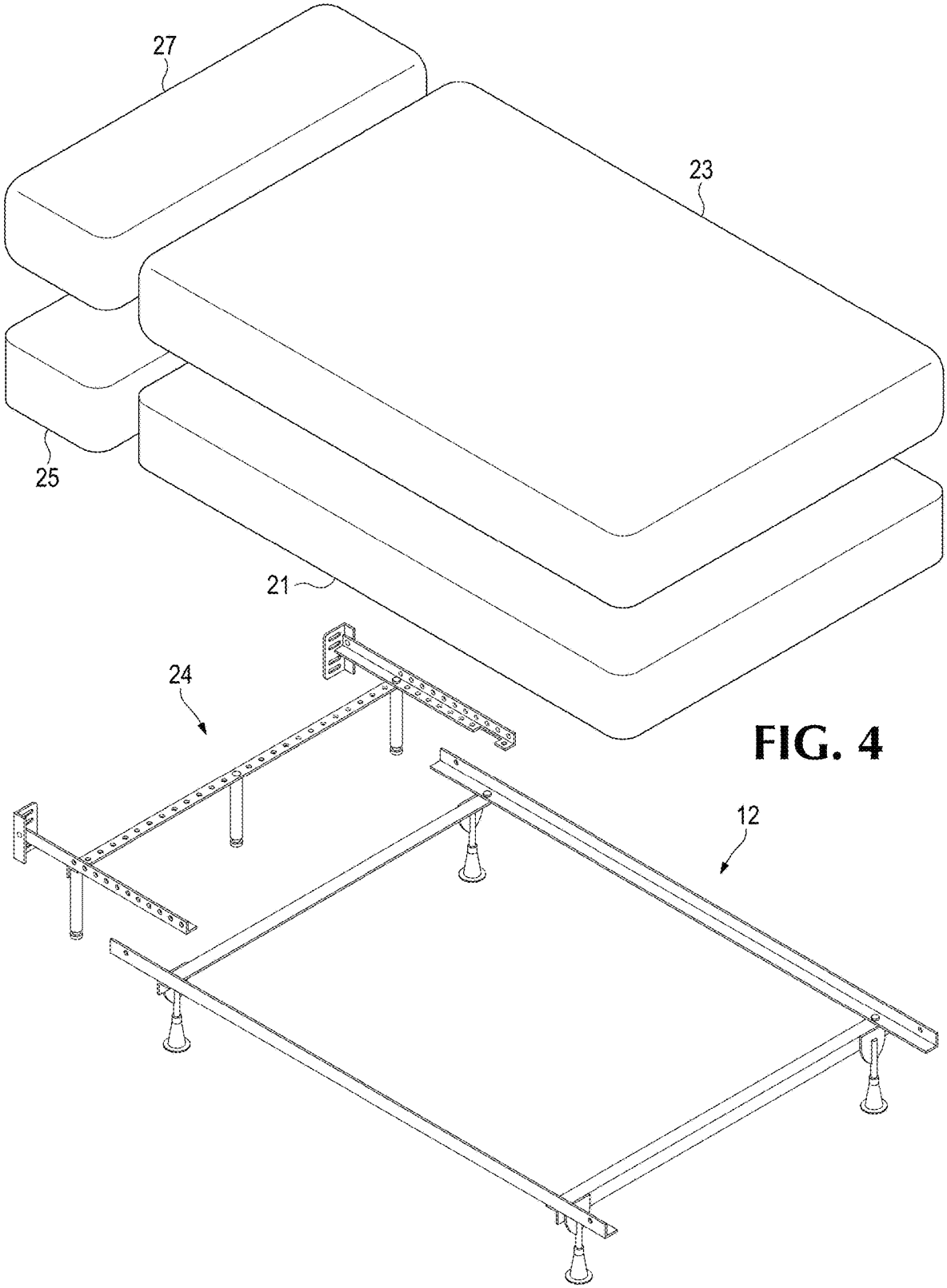
FIG. 4 is a partial exploded view of FIG. 1, illustrating the assembly of the bedframe, boxspring/platform, and mattress extensions.

Referring to FIGS. 1 and 4, an adjustable bed extension system 10 is depicted in relation to an existing bed setup, illustrating the components designed to extend the usable length of the bed. The existing bed comprises an existing bedframe 12, an existing boxspring 21, and an existing mattress 23. These components may vary in size, including twin, full, queen, king, California king sizes, etc. The existing bed may also include a headboard and/or a footboard. Otherwise, a backer board may optionally be used. The bed extension system 10, in embodiments, includes a bedframe extension 24, a boxspring/platform extension 25, and a mattress extension 27, collectively providing a comprehensive solution for accommodating individuals with specific height requirements or those seeking additional sleeping space.

Figure 5:
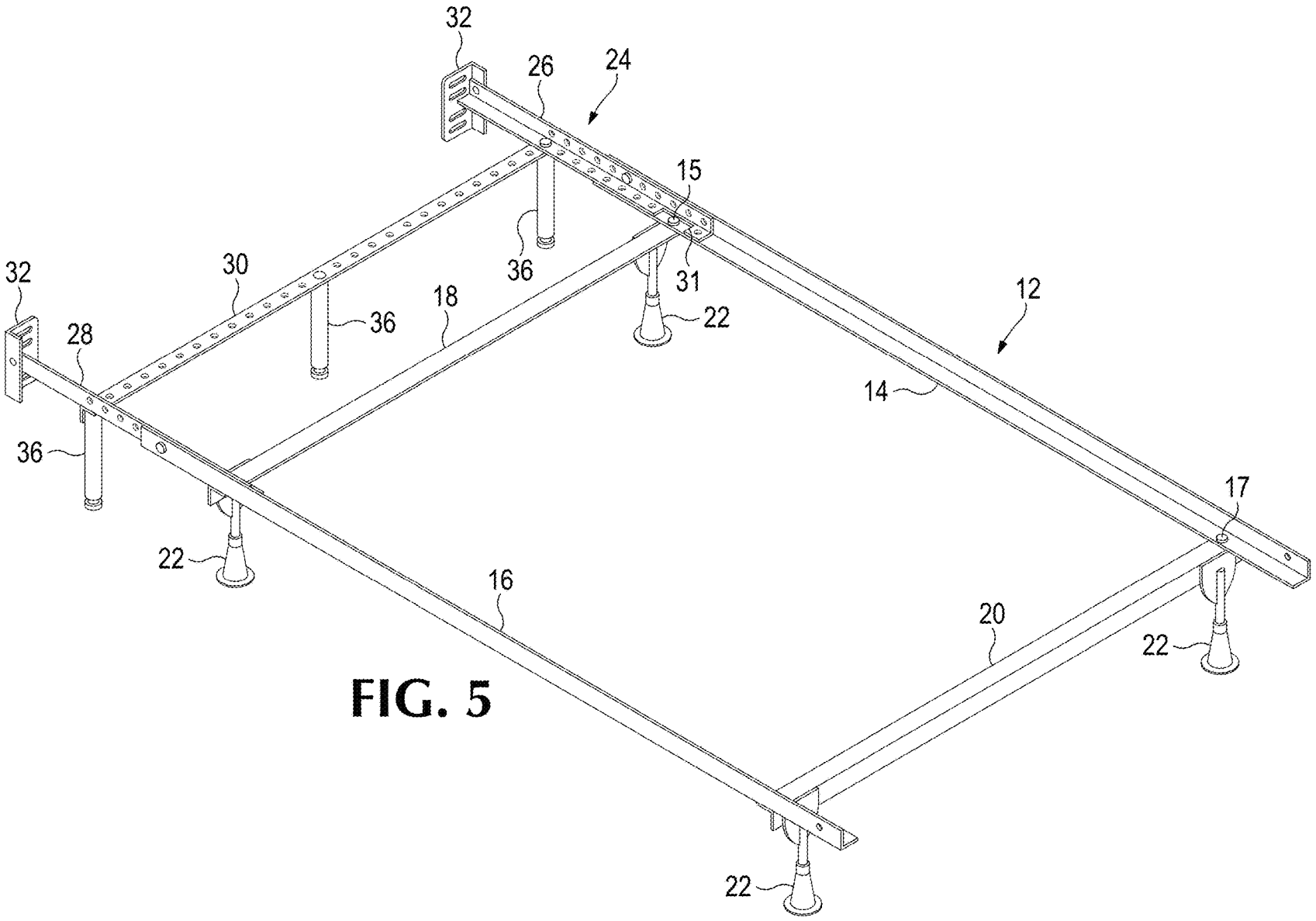
FIG. 5 is a perspective view of the bedframe extension of FIG. 1 attached to a bed, illustrating the structure at the head end.
Figure 7:
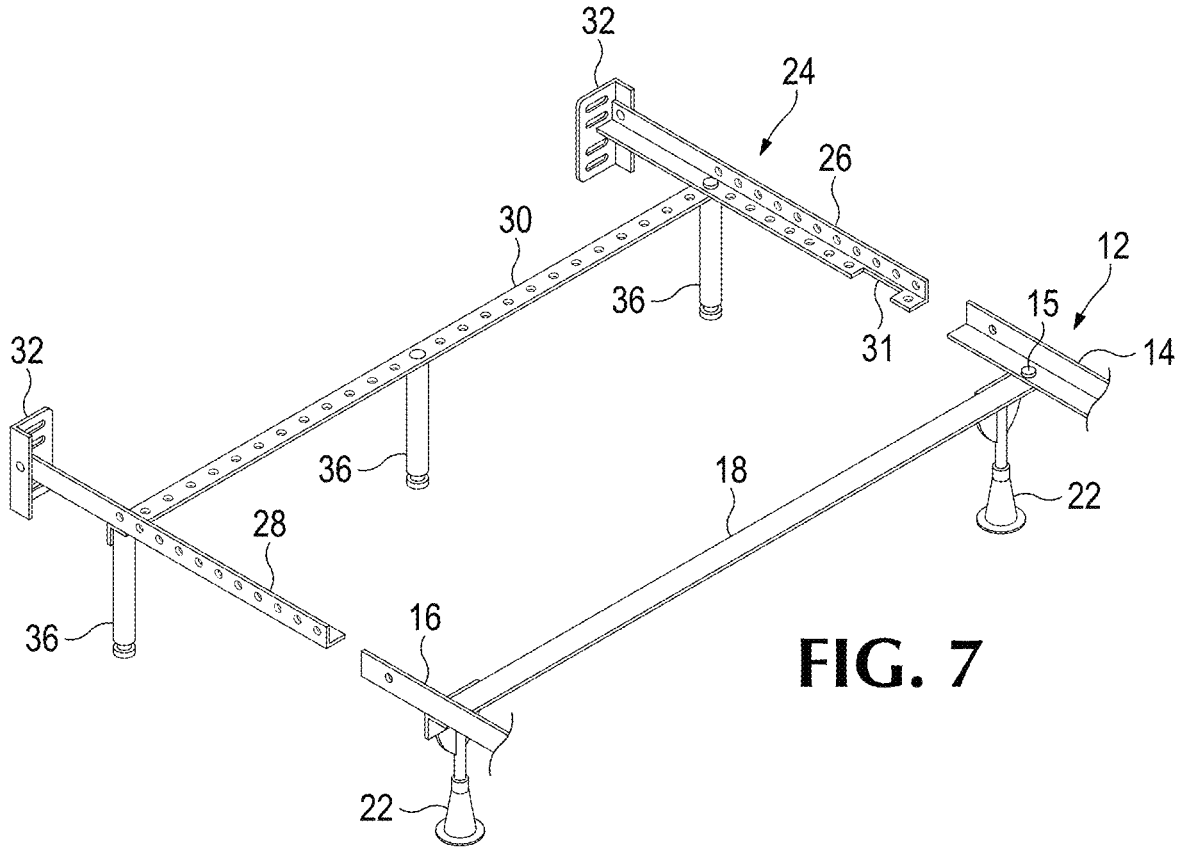
FIG. 7 is a partial view of FIG. 5, illustrating the head end bedframe extension portion and detailing the connection between the existing bedframe and the bedframe extension.

The bedframe extension 24 incorporates two adjustable support beams 26, 28, each may be featuring adjustable legs 36 to accommodate various bed heights and preferences, as shown in FIGS. 5 and 7. The adjustable legs 36 can be adjusted up to approximately 10 inches to match the height of the existing bedframe or both the bedframe and existing boxspring. The adjustable legs 36 may be installed on a crossbar 30, the support beams 26, 28, or both.

The support beams 26, 28 are designed to extend the length of the existing bedframe 12, wherein support beam 26 extends existing support beam 12, and support beam 28 extends existing support beam 16. This provides a sturdy base for the mattress extension 27. These support beams 26, 28 are adjustable using mechanisms such as telescoping designs or adjustable screws and or bolts with nuts, allowing for seamless integration with different bedframes. In preferred embodiments, supporting beams 26, 28 are outfitted with a preexisting cutout 31 of sufficient length to accommodate an existing bolt 15 in the existing bedframe 12. The cutout length, in embodiments, is approximately 8 inches but may be made more or less in some instances.

Adjustably connecting the support beams 26, 28 is the crossbar 30. The length of the crossbars 30 may be specific to a bed size or adjusted to match the width of the existing bedframe 12, ensuring proper support for the mattress. This adjustability can be achieved using various mechanisms, such as telescoping designs, adjustable screws, nuts and bolts with pre-drilled holes at different positions along the crossbars 30, or sliding channels within the crossbar 30 structure to accommodate locking pins or mechanisms. The crossbar 30 is outfitted with pre-drilled holes designed to receive one or more adjustable legs 36, although depending on the embodiment, the adjustable legs 36 may not be required due to the design of the existing bed frame.

Completing the bedframe extension 24 is a pair of brackets 32 having several horizontal pre-drilled cutouts. In embodiments, the bracket 32 is alternatively outfitted with vertical pre-drilled cutouts, or a combination of horizontal and vertical cutouts. Each bracket 32 is used at one end of each support beam 26, 28. In embodiments where the existing bedframe 14 includes a corner bracket 34 at the end of existing support beams 12, 16, an additional pair of brackets 32 may be included at the opposite end of support beams 26, 28 to cooperate, align, and attach to the corner brackets 34. Although not shown, a solid surface may be utilized atop the bedframe extension 24 to provide support to the mattress extension 27. Examples of such solid surfaces include plywood, particleboard, or a series of slats made from materials like hardwood or metal. Additionally, wooden support bars, similar to those traditionally used across a bedframe to support a mattress, may also be employed. These options offer various degrees of support and can be chosen based on specific structural requirements and material preferences.

The boxspring/platform extension 25 is optional and is designed to match the size of the bedframe extension 24, providing additional support for the mattress extension 27. It can be constructed using various materials, such as wood, metal, or a combination thereof, ensuring durability and stability. One option includes constructing a sturdy frame using steel or hardwood with dimensions that align with those of the bedframe extension. Alternatively, an adjustable boxspring/platform extension may be employed, featuring telescoping or folding mechanisms to accommodate different boxspring heights and dimensions.

The mattress extension 27 completes the system, matching the size and dimensions of the bedframe extension 24 to provide a seamless sleeping surface. It may be constructed of materials such as foam, springs, natural or other materials, or a combination thereof, ensuring optimal comfort and support for the user. The mattress extension may feature a curved design on one end to blend with the existing mattress and cover any gap, creating a smooth transition between the two sections.

Figure 3:
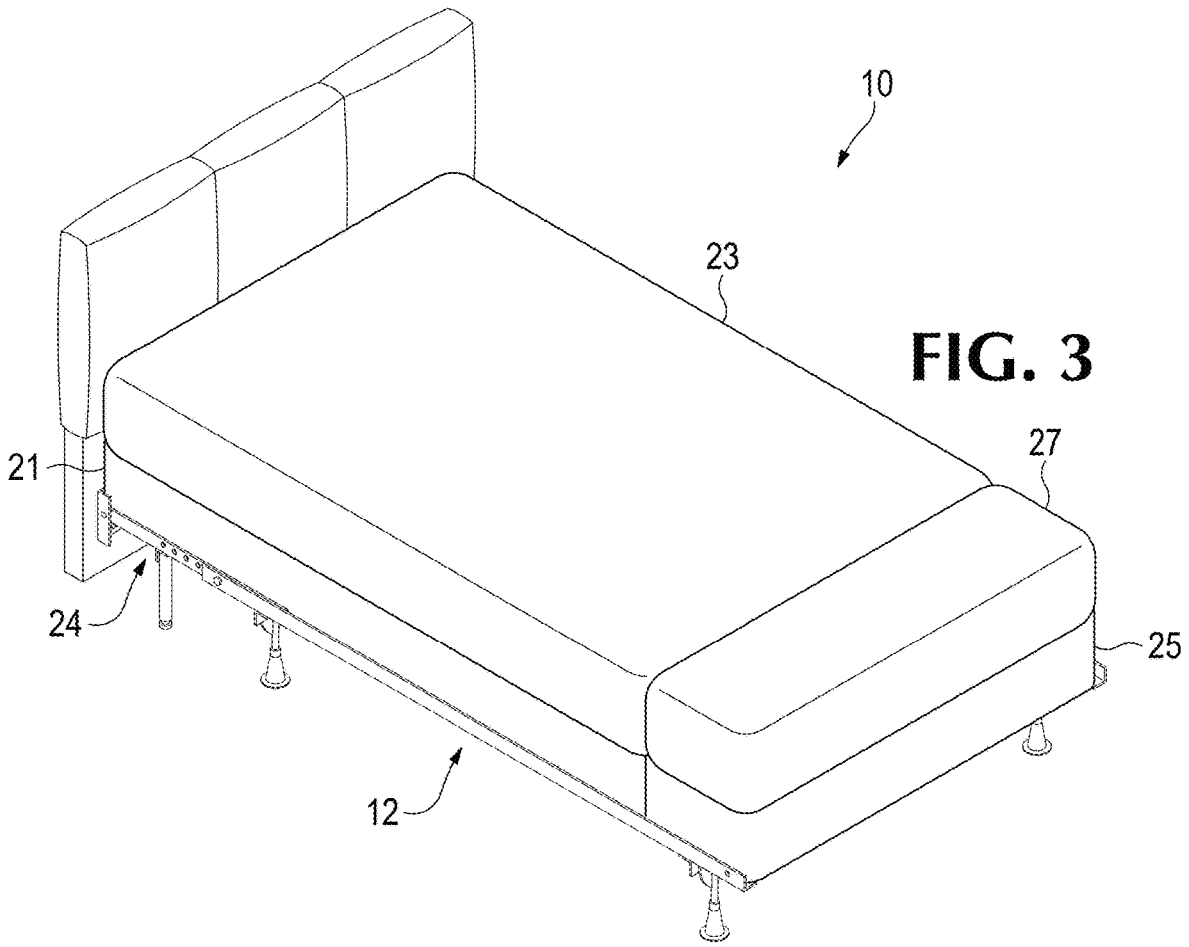
FIG. 3 is a perspective view of the embodiment of a bedframe, boxspring/platform, and mattress extensions of FIG. 1, with an existing boxspring/platform and mattress being placed on the bedframe extension portion, and the boxspring/platform and mattress extensions being placed on the foot end of the existing bedframe.

In preferred embodiments, a bed extension system 10 as shown in FIG. 3 is utilized. Shown there, the existing boxspring 21 and existing mattress 23 are placed on the bedframe extension 24 and the extension/platform boxspring 25 (if any) and extension mattress 27 being placed on the existing bedframe 12. Meaning, the existing mattress 21 may be pushed onto the bedframe extension 24 leaving the mattress extension 27 room to fit onto the existing bedframe 12.

Figure 2:
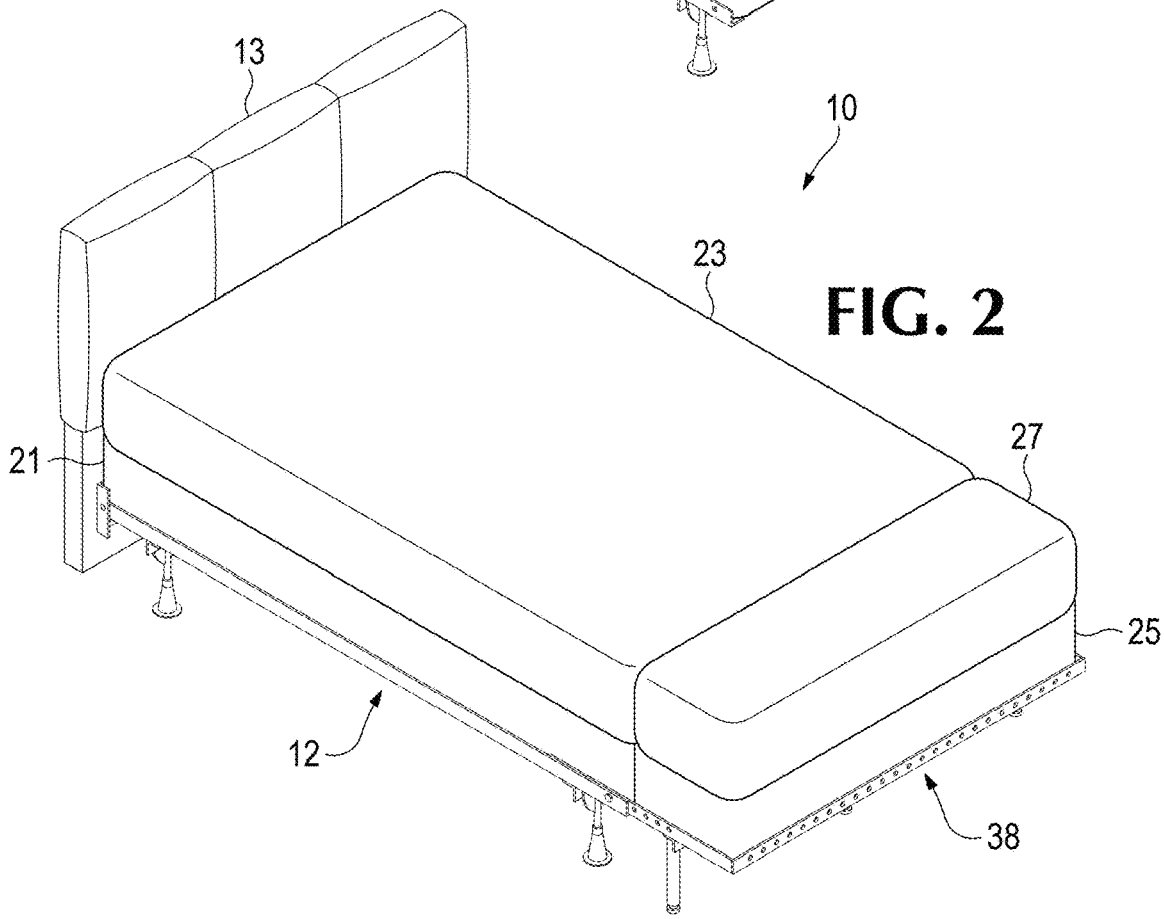
FIG. 2 is a perspective view of an embodiment of a bedframe, boxspring/platform, and mattress extensions at the foot end of a bed.

While FIGS. 1, 3-5, and 7 describe a bed extension system 10 at the head end of an existing bed, a similar system may be utilized at the foot end of an existing bed as shown in FIGS. 2, 6, 8, and 9. FIG. 2 illustrates a bed extension system 10 at the foot end of an existing bed setup, providing an equally comprehensive solution for individuals requiring additional sleeping space. The existing bed consists of an existing bedframe 12, an existing boxspring 21, an existing mattress 23, and an optional backer board 13. The foot end bed extension system 10 includes a foot end bedframe extension 38, an extension boxspring/platform 25, and an extension mattress 27, and a backer board, offering versatility and adaptability to various bed configurations. A backer board 13 to contain and provide support in the absence of a footboard.

The foot end bedframe extension 38, depicted in FIG. 2, extends the length of the existing bedframe 12, providing a sturdy base for the extension boxspring/platform 25 and mattress 27. Similar to the head end extension system, it features adjustable support beams 40, 42, each equipped with adjustable legs 48 to accommodate different bed heights and preferences. The support beams 40, 42 are designed to connect with existing support beams 14, 16 of the existing bedframe 12, ensuring stability and compatibility with various bedframe configurations. This can be done, in preferred embodiments, by outfitting the supporting beams 40, 42 with preexisting cutouts 43 of sufficient length to accommodate an existing bolt 17 in the existing bedframe 12. The cutout length, in embodiments, is approximately 6 inches but may be made more or less in some instances.

Figure 6:
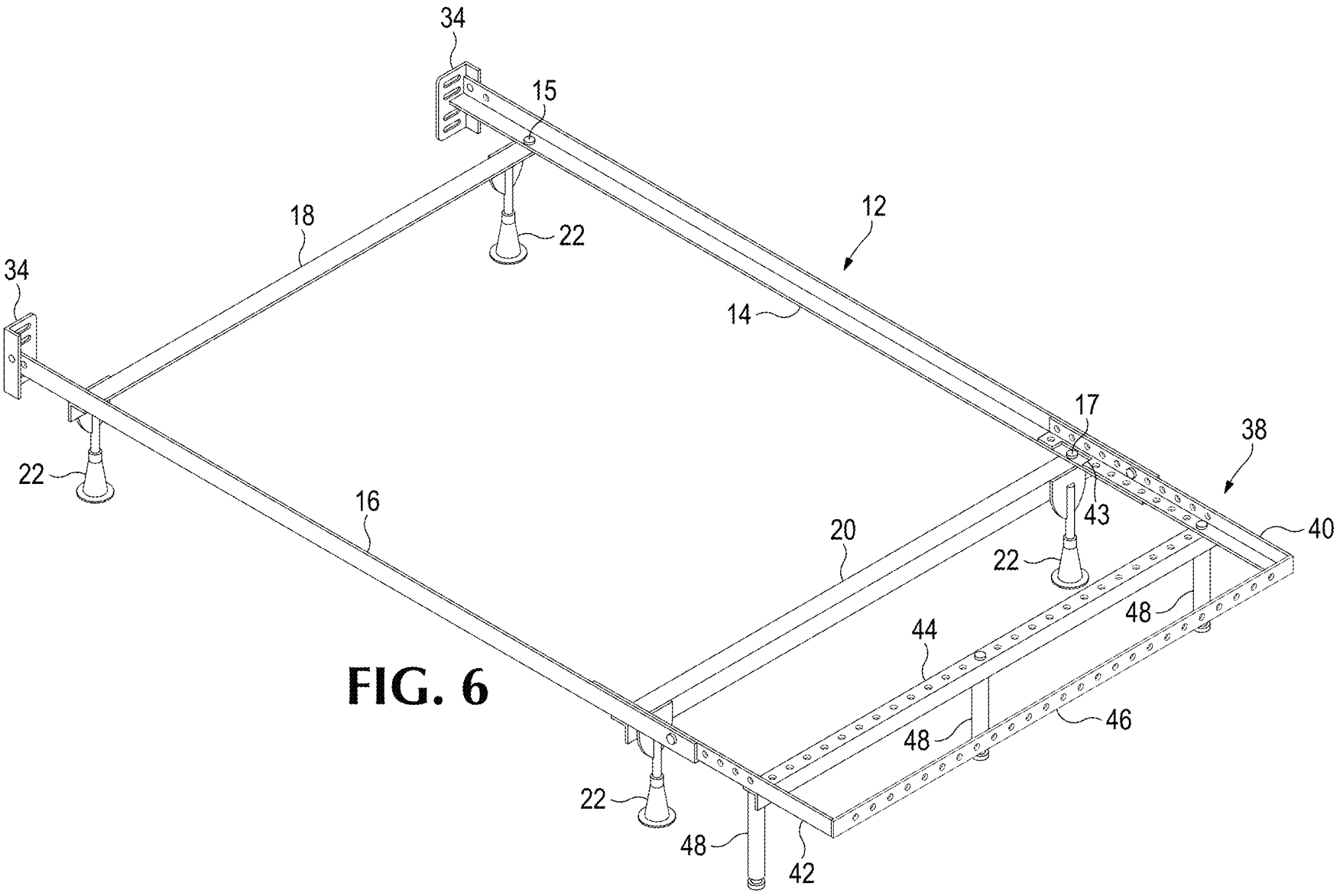
FIG. 6 is a perspective view of the bedframe extension of FIG. 2 attached to a bedframe, illustrating the structure at the foot end with an additional enclosure at the foot end.
Figure 8:
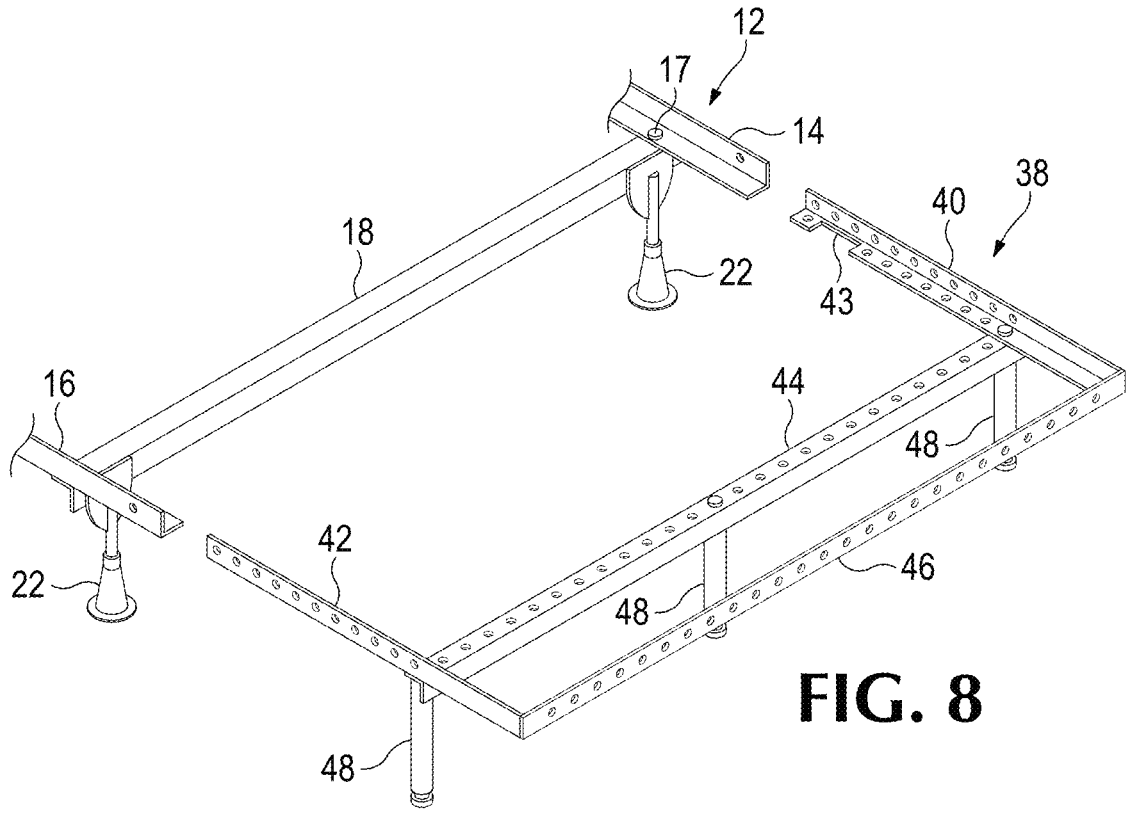
FIG. 8 is a partial view of FIG. 6, illustrating the foot end bedframe extension portion and detailing the connection between the existing bedframe and the bedframe extension.

In FIGS. 6 and 8, further details of the foot end bedframe extension system 10 are provided. The support beams 40, 42 extend from the existing bedframe 12 and are connected by a crossbar 44 to enhance stability and support. Adjustable legs 48 are attached to the support beams 40, 42, and/or the crossbar 44, using pre-drilled holes, allowing for height adjustments to match the existing bedframe or boxspring. An additional corner crossbar 46 is attached at one end of and connects the support beams 40, 42, providing additional reinforcement and stability, and may serve as an additional attachment point for any backer board. Alternatively, the support beams 40, 42 may be outfitted with brackets, and the brackets may serve as attachment points for a backer board or a footboard.

While adjustable legs 48 are depicted in FIGS. 6 and 8, it should be understood that the use of adjustable legs is not required for the extension system 10. Alternative support for the extension system 10 can be provided by attaching it to an existing footboard or to a backer board equipped with its own legs.

Figure 9:
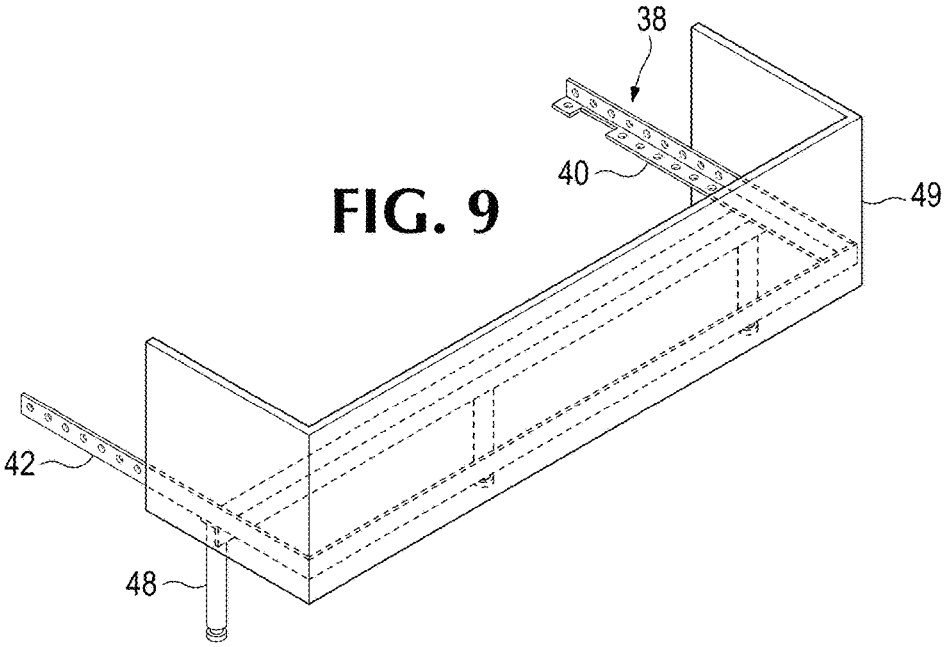
FIG. 9 is a perspective view of the foot extension portion of FIG. 8, illustrating the incorporation of a backer board to contain the boxspring/platform and mattress, or portions thereof.

FIG. 9 introduces an optional wrap-around backer board 49, as utilized in some embodiments, can be used at either the foot or head end of the systems, serving to partially or fully encapsulate the bedframe extension 38, extension boxspring/platform 25, and the mattress extension 27. Likewise, this system may also be used at the head end of systems lacking headboards that would otherwise contain and provide necessary backing for the mattress extension. This wrap-around design provides a finished look to the extended bedframe while also enhancing stability and support. The backer board 49 ensures that all components of the bed extension system are securely held in place, creating a seamless and cohesive appearance.

The backer board 49 may be configured to be one-sided. While the backer board is referred to herein as a "board," it is to be understood that it can be made of various materials such as wood, stiff plastic, wire/rod, steel, or other frameworks to contain and secure the mattress extension. Other options include Velcro-like attachments or securing with a band/lash type system. In addition, the backer board 49 may be utilized for systems extending existing bed at both ends, the head end and the foot end.

Figure 10:
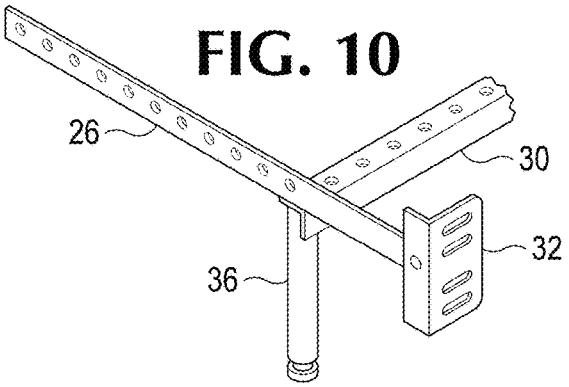
FIG. 10 is a perspective view of a connection mechanism utilized to extend an existing bedframe at either the foot or head end.

FIG. 10 illustrates a bracket 32, as described previously, which serves as a secure connection point for the bedframe extensions 24, 38. As an example, it is shown connected to support beam 26, although it may be connected to any of the support beams 26, 28, 40, or 42, depending on the specific bed configuration. The bracket 32 features several horizontal pre-drilled cutouts and may also include vertical cutouts to accommodate various attachment scenarios, ensuring proper alignment and support of the bedframe extension. In some embodiments, the bracket 32 is integrated into the support beams 26, 28, 40, or 42.

Figure 11:
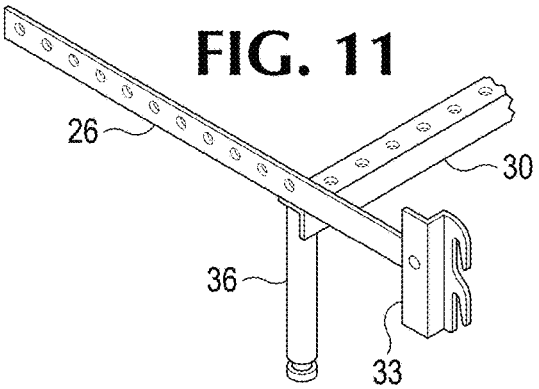
FIG. 11 is a perspective view of an alternative connection mechanism to the one shown in FIG. 10 and utilized to extend an existing bedframe at either the foot or head end.
Figure 12:
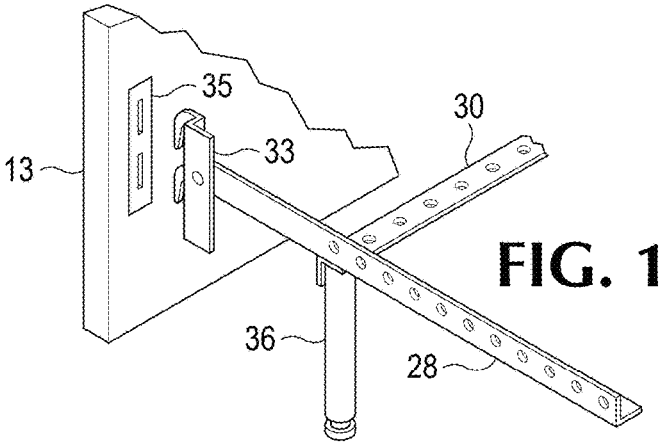
FIG. 12 is a perspective view of the alternative connection mechanism of FIG. 11 further illustrating the connection mechanism and detailing a hook and slot components of the connection mechanism.

FIGS. 11 and 12 depict an alternative bracket design with a hook attachment 33 and hook receiving slots 35. The attachment 33 can be connected to any of the support beams 26, 28, 40, or 42, similar to the configuration shown in FIG. 10. The hook receiving slots 35 may be a part of the backer board 13, a footboard, a backer board, or mounted on any suitable surface where the bedframe extension is intended to be attached. This alternative bracket design offers flexibility in installation of different existing bedframe configurations and allows for secure attachment of the bedframe extension.

Figure 13:
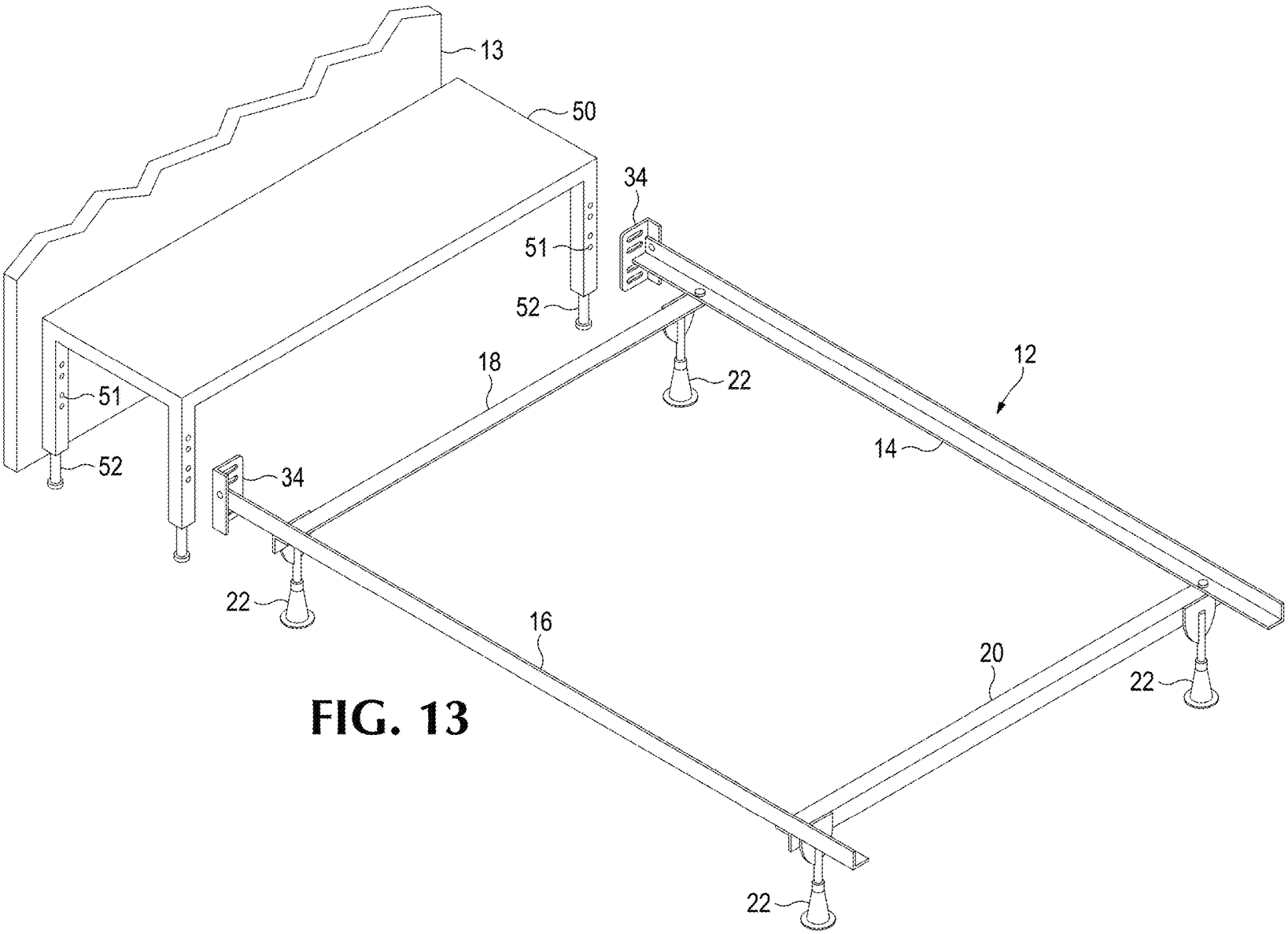
FIG. 13 is a perspective view of an alternative embodiment to the bedframe, boxspring/platform, and mattress extensions of FIGS. 1 and 2, wherein an adjustable platform is used as an adjustable combination of the bedframe and boxspring/platform extensions.

FIG. 13 presents an alternative embodiment of the adjustable bed extension system 10, which includes an adjustable platform 50, optional boxspring/platform extension, and mattress extension 27. This embodiment offers a comprehensive solution for extending the usable length of beds while providing versatility and adaptability to various bed and frame configurations.

The adjustable platform 50 serves as the foundation of the system, offering four height-adjustable legs 52. Depending on the embodiment, additional or fewer legs may be used. In embodiments, three legs 52 are utilized, one at each end and one in the center. In other embodiments, five legs 52 are utilized, one at each corner and one at the center. In yet further embodiments, six legs 52 are utilized, one at each corner and two around the center towards the edge of the platform. In embodiments, eight legs 52 may be utilized, one at each corner and four equally spaced in the center. Regardless of the number of legs 52 utilized, they are substantially similar as described below.

In embodiments, the legs 52 are capable of adjusting up to approximately 10 inches to accommodate various bed heights and preferences. The legs 52 feature several cutouts 51, or may be drilled, to allow them to attach securely to existing brackets 34 in the existing bedframe 12 or, in the absence of existing brackets 34, brackets 32 similar to those previously discussed are included. The height adjustability of the legs 52 enables seamless integration with different bedframes, ensuring proper alignment and stability.

Two of the legs 52 are designed to connect to a backer board 13, footboard, headboard, or remain unsecured, while the remaining legs 52 directly connect to the existing bedframe 12, providing additional stability and support. These connections can be achieved using brackets, screws, or other suitable fasteners, allowing for secure attachment to the existing bed structure, including many platform or wood style frames.

The adjustable platform 52 is made of sturdy materials such as 2×4 or other dimensional lumber or metal framing, ensuring durability and stability. While it is shown as a flat surface, it can incorporate mechanism and configurations similar to those discussed above with respect to the boxspring/platform extension, making the platform 50 height adjustable. Moreover, a solid surface may be utilized atop the platform 50 to provide support to the mattress extension 27. The surface and dimensions of the platform 50 match those of the desired extension, providing a solid base for the mattress extension 27 or existing mattress 23. The platform 50 ensures even weight distribution for optimal comfort and support, and its height can be adjusted to match the existing boxspring height, eliminating the need for additional boxspring/platform extensions in many cases.

If the top of the platform 50 matches the needed height of the existing boxspring 21, only a mattress extension 27 is needed on top of the platform 50 to complete the system. This streamlined design reduces the need for additional components and simplifies installation. However, if the top of the platform does not provide sufficient height to align with the existing boxspring 21, an optional boxspring/platform extension 25 may be included. This extension increases the height of the platform 50, provides additional support for the mattress extension 27, and ensures a seamless transition between the existing mattress 23 and the mattress extension 27.

The height of the adjustable platform 50 can be modified using different length materials such as blocks or dimensional lumber. In one embodiment, blocks of varying heights can be placed under the platform 50 to achieve the desired height. These blocks can be made of wood, plastic, or any other sturdy material capable of supporting the weight of the platform 50 and mattress. Alternatively, dimensional lumber cut to specific lengths can be used to adjust the platform 50 height. This lumber can be secured to the platform 50 using screws, brackets, or fasteners to ensure stability. The lumber pieces can be easily swapped out to change the height as needed.

In another embodiment, the platform 50 includes slots or grooves designed to accommodate height-adjusting blocks. These blocks can be inserted into the slots and secured using a locking mechanism to prevent movement. This design allows for quick and easy adjustments to the platform height without the need for tools.

Furthermore, the adjustable legs of the platform 50 can include removable inserts of different heights. These inserts can be placed inside the legs to adjust the overall height of the platform 50. This feature provides a flexible solution for accommodating various bed heights and user preferences. By incorporating these height adjustment mechanisms, the adjustable platform 50 system offers a versatile and customizable solution for extending the usable length of beds, ensuring optimal comfort and support for users of different heights and preferences.

Figure 14:
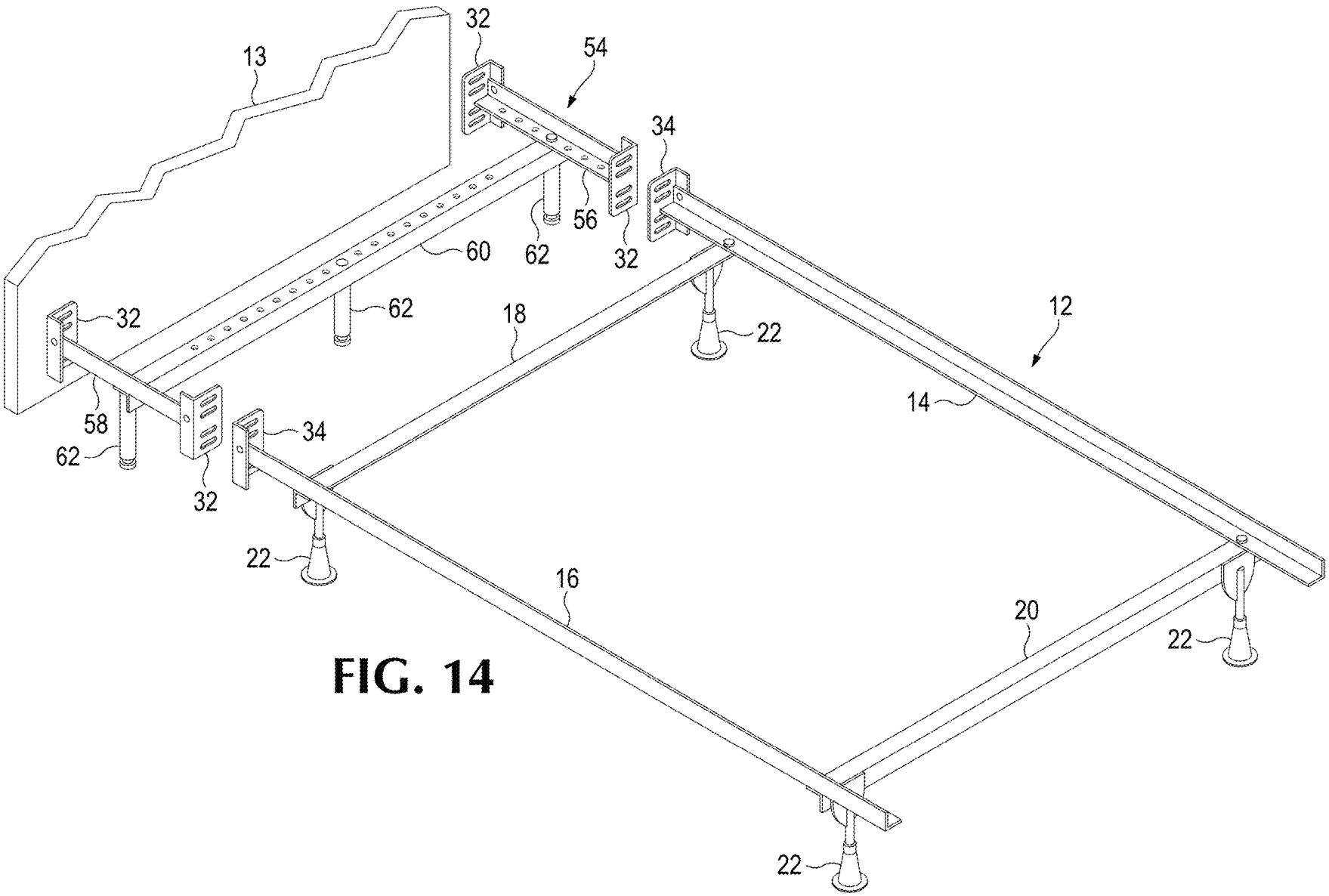
FIG. 14 is a perspective view of another alternative embodiment of the bedframe, boxspring/platform, and mattress extensions of FIG. 1, where an adjustable platform is used as either the bedframe and boxspring/platform extensions, or a combination of both.
Figure 15:
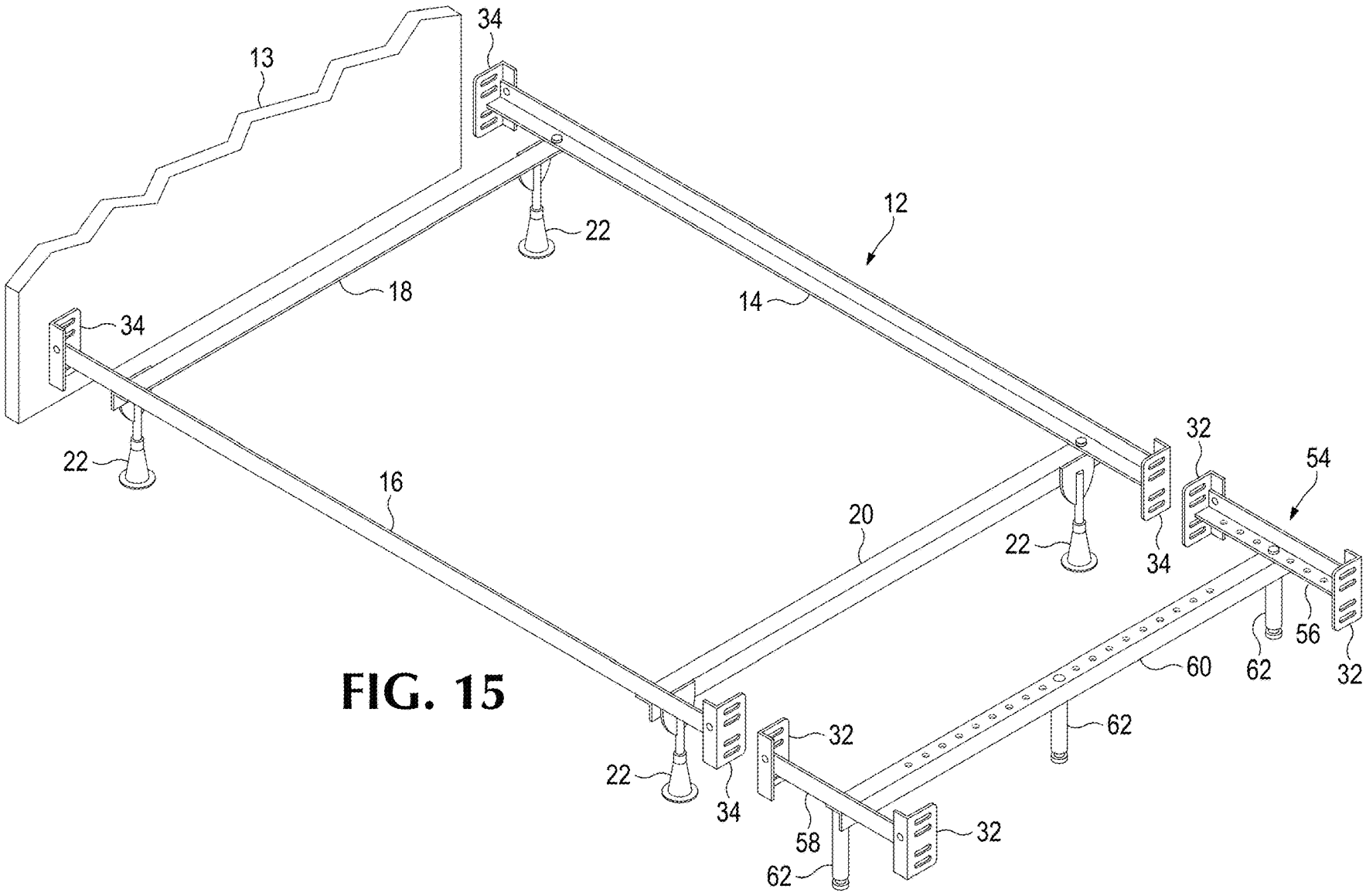
FIG. 15 is a perspective view of another alternative embodiment of the bedframe, boxspring/platform, and mattress extensions of FIG. 2, where an adjustable extension is used as either the bedframe and boxspring/platform extensions, or a combination of both.

FIGS. 14 and 15 illustrate an alternative embodiment to the adjustable bed extension system 10, which substantially retains the fundamental design elements of the first embodiment and introduces two modifications for enhanced stability and versatility. This embodiment comprises a bedframe extension 54, optional boxspring/platform extension 25, and mattress extension 27, offering yet another efficient and versatile solution for extending the length of beds.

The bedframe extension 52 features two support beams 56, 58, each may be equipped with adjustable support legs 62 and crossbars 60 connecting the support beams 56, 58 to provide additional support and stability. Unlike the first embodiment, in some embodiments, the support beams in this embodiment do not incorporate cutouts. Instead, they are designed to securely attach to existing bedframes 12 that use a bracket 32 as previously described, without the need for modification.

In embodiments, the support beams 56, 58 may be adjustable to accommodate different bedframe 12 configurations. This adjustability is achieved through mechanisms such as telescoping designs, where sections of the support beams can slide into each other, or adjustable screws and bolts with pre-drilled holes at different positions along the beams, allowing for manual adjustment of the length. In other embodiments, each of the support beams 56, 58 may be composed of two support beams that slide on top of one another and can be secured with a bolt or pin design at the desired extension. This allows for easy adjustment of the length by simply sliding the beams to the desired position and securing them in place with the bolt or pin.

Each support beam 56, 58 is outfitted with two brackets 32, one at each end, to facilitate attachment to the existing bedframe 12, and optionally, a backerboard 13, footboard, or a headboard. These brackets 32 serve as secure connection points, ensuring proper alignment and stability of the extension bedframe. The brackets 32 are height adjustable to accommodate different bedframe configurations and can be easily adjusted to match the height of the existing bedframe 12.

The adjustable support legs 62 of the bedframe extension are designed to accommodate various bed heights, allowing for seamless integration with existing bedframes. In embodiments, the legs 62 may be adjustable up to approximately 10 inches. This design provides flexibility in installation and ensures a secure and stable connection between the bedframe extension 54 and the existing bedframe 12.

The optional boxspring/platform extension 25 in the third embodiment is similar to that of the first embodiment and can be adjusted to match the height and dimensions of the existing boxspring/platform 21. It may feature telescoping or folding mechanisms to accommodate different boxspring configurations, providing additional support for the mattress extension.

The mattress extension 27 in the third embodiment is designed to match the size and dimensions of the extended bedframe, providing a seamless sleeping surface for the user. It may be constructed of various materials, such as foam, springs, or a combination thereof, to achieve the desired level of comfort and support.

While the application discusses bed extension systems at both the foot end and head end of an existing bed, it is to be understood that either extension can be used interchangeably on either end of the bed. The terms 'foot end' and 'head end' are utilized solely for reference in the drawings and should not be interpreted as limiting the application of the described embodiments. Both extensions offer versatility and can be adapted to suit various bed configurations and user preferences, including bed width extensions.

The adjustable bed extension system presented herein offers a versatile solution for addressing the limitations of traditional bed designs, providing additional length to existing beds without the need for costly custom-made alternatives. By incorporating adjustable support beams, crossbars, and optional boxspring/platform extensions, adjustable platform, extension mattress, adjustable legs, and/or backer board, this system accommodates various bed sizes and heights, ensuring optimal comfort and support for users of different heights and preferences. Whether utilized at the head end or foot end of existing bedframes, the system enhances stability and compatibility, making it suitable for a wide range of applications and environments, including those requiring or wishing additional space for optimal rest and recovery.

In addition to the foregoing description, it is to be understood that various embodiments and modifications of the invention may be readily apparent to those skilled in the art without departing from the spirit or scope of the present invention. Furthermore, it should be noted that any dimensions or specifications that may be provided in this disclosure and drawings are intended to be purely illustrative and not necessarily to scale, serving primarily as aids to comprehension rather than precise measurements.

As such, within the scope of this invention, an extensive array of alternative embodiments may be used, including various materials, sizes, locking mechanisms, and methods of attachment. This adaptability ensures the invention can be tailored to meet diverse requirements.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

I claim:

1. An adjustable bed extension system comprising:

a bedframe extension having two support beams and one or more crossbars connecting said support beams, wherein each of the two support beams includes an elongate horizontal portion and an elongate vertical portion, and wherein the one or more crossbars include an elongate horizontal portion, wherein the two support beams are configured to be connected to a head end or a foot end of a bedframe, the bedframe extension being independent and distinct from the bedframe; and a mattress extension that is independent and distinct from the bedframe extension and from the bedframe, the mattress extension having one or more surfaces that define an enclosed volume.

2. The adjustable bed extension system of claim 1, wherein each of the two support beams is L-shaped.

3. The adjustable bed extension system of claim 1, wherein the elongate horizontal portion is planar and the elongate vertical portion is planar.

4. The adjustable bed extension system of claim 1, wherein at least one of the elongate horizontal portion and the elongate vertical portion includes a plurality of spaced holes.

5. The adjustable bed extension system of claim 1, wherein the one or more crossbars include a plurality of spaced holes.

6. The adjustable bed extension system of claim 1, further comprising a boxspring extension sized to be supported on the support beams and the crossbars and disposed between the bedframe extension and the mattress extension.

7. The adjustable bed extension system of claim 6, further comprising a backer board attached to the bedframe extension.

8. The adjustable bed extension system of claim 7, further comprising one or more adjustable support legs attached to the bedframe extension and configured to support the bedframe extension on a support surface.

9. The adjustable bed extension system of claim 1, further comprising brackets attached to one end of each of the support beams.

10. The adjustable bed extension system of claim 9, wherein each of the support beams is adjustable using telescoping designs.

11. The adjustable bed extension system of claim 1, further comprising brackets attached to both ends of each of the support beams.

12. The adjustable bed extension system of claim 11, wherein each of the support beams is outfitted with a preexisting cutout.

13. The adjustable bed extension system of claim 1, wherein said boxspring extension is height adjustable.

14. The adjustable bed extension system of claim 1, wherein said mattress extension features a curve on one side of said mattress extension.

15. The adjustable bed extension system of claim 1, further comprising locking mechanisms for securing the position of said support beams relative to said existing bedframe.

16. The adjustable bed extension system of claim 15, wherein said locking mechanisms include one or more locking plates, and locking screws and bolts, nuts, or pins.

17. The adjustable bed extension system of claim 1, wherein the mattress extension is sized to be supported on the horizontal portion of the two support beams and on the horizontal portion of the one or more crossbars.

18. The adjustable bed extension system of claim 17, wherein the mattress extension is sized to be disposed between the vertical portions of the two support beams.

19. An adjustable bed extension system comprising:

a bedframe extension having two support beams and one or more crossbars connecting said support beams, wherein each of the two support beams includes an elongate horizontal portion and an elongate vertical portion, and wherein the one or more crossbars include an elongate horizontal portion; and a mattress extension that is independent and distinct from the bedframe extension, the mattress extension having one or more surfaces that define an enclosed volume, wherein the system is adaptable between first and second configurations, wherein, in the first configuration, the bedframe extension is attached to a bedframe and the mattress extension is supported on the bedframe extension, and, in the second configuration, the bedframe extension is detached and spaced from the bedframe and the mattress extension is spaced from the bedframe extension, wherein the bedframe is independent and distinct from the bedframe extension and the mattress extension.

* * * * *